United States Patent [19]

Rao et al.

[11] Patent Number: 4,924,842

[45] Date of Patent: May 15, 1990

[54] OPTIMIZATION METHOD AND APPARATUS FOR DRESSING A GRINDING WHEEL

[75] Inventors: Suren B. Rao, Troy; Richard W. Schwartz, Mt. Clemens, both of Mich.

[73] Assignee: National Broach & Machine Company, Mt. Clemens, Mich.

[21] Appl. No.: 411,244

[22] Filed: Sep. 22, 1989

Related U.S. Application Data

[63] Continuation of Ser. No. 214,119, Jun. 30, 1988, abandoned.

[51] Int. Cl.[5] ..... B24B 53/00

[52] U.S. Cl. ..... 125/11.01

[58] Field of Search ..... 125/11 R, 11 CD, 11 AT, 125/11 H, 11 NT; 51/5 D, 165.87, 325

[56] References Cited

U.S. PATENT DOCUMENTS

| | | | |
|---|---|---|---|
| 4,085,554 | 4/1978 | Susita | 125/11 NT |
| 4,163,346 | 8/1979 | Matson | 125/11 R |
| 4,180,046 | 12/1979 | Kerner | 125/11 AT |
| 4,461,125 | 7/1984 | Wuest | 125/11 R |
| 4,551,950 | 11/1985 | Unno et al. | 125/11 CD |
| 4,603,677 | 8/1986 | Gile et al. | 125/11 R |
| 4,731,954 | 3/1988 | Lilientein | 125/11 R |

*Primary Examiner*—Judy Hartman

*Attorney, Agent, or Firm*—Barnes, Kisselle, Raisch, Choate, Whittemore & Hulbert

[57] ABSTRACT

An optimization method of dressing a predetermined profile on the periphery of a grinding wheel of the type used in form grinding. A dresser is guided along a path corresponding to the predetermined grinding wheel profile in successive, identical cycles of motion. The grinding wheel is fed into the path in increments between cycles. The dresser contacts the periphery of the grinding wheel during movement along its path, with the duration of contact increasing in each cycle until the predetermined profile is produced. The duration of contact during each cycle is monitored. When the difference between the duration of contact in a given cycle and the duration of contact in the previous cycle is zero or negligible, dressing is complete. Apparatus for practicing the method is also disclosed.

12 Claims, 3 Drawing Sheets

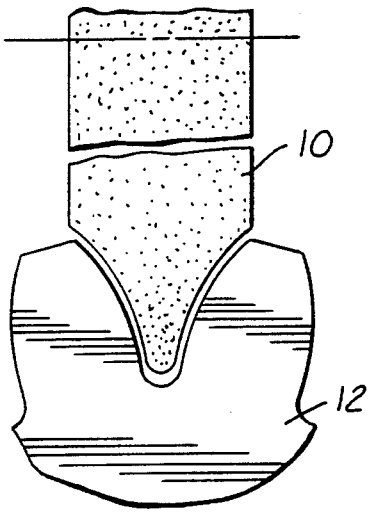
FIG.1
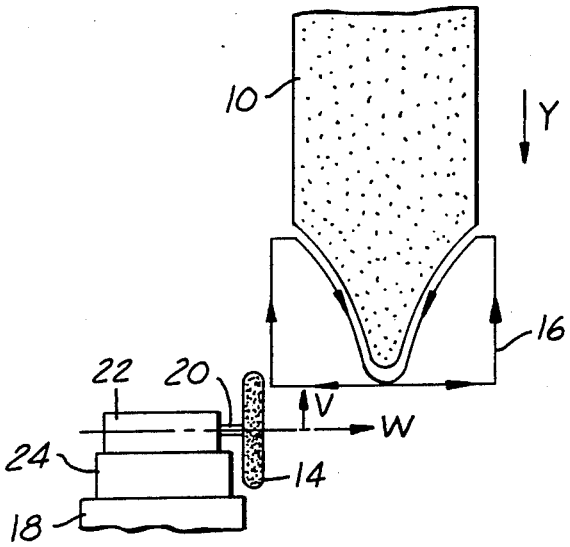
FIG.2
FIG.3
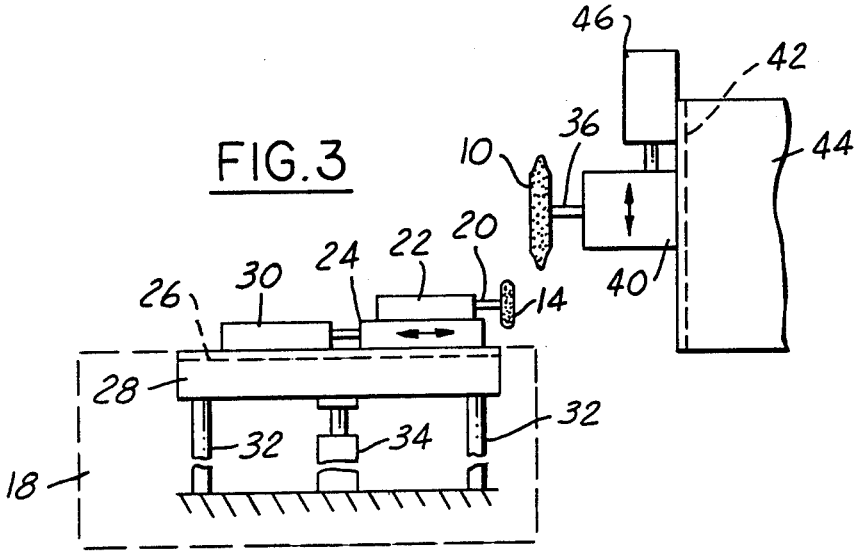
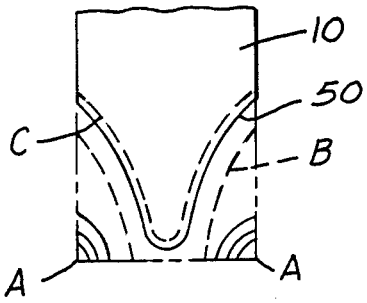
FIG.4
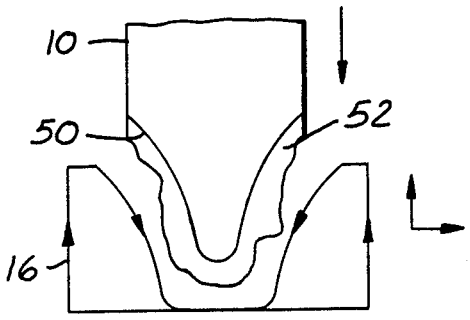
FIG.5

OPTIMIZATION METHOD AND APPARATUS FOR DRESSING A GRINDING WHEEL

This is a continuation of copending application Ser. No. 07/214,119 filed on June 30, 1988 now abandoned.

This invention relates generally to the profiling of grinding wheels and refers more particularly to an optimization technique for profiling a grinding wheel of the type used in form grinding.

BACKGROUND AND SUMMARY OF THE INVENTION

"Dressing" is the word used to describe the process of profiling a grinding wheel of the type used in a "form grinding" operation. Dressing is necessary because in form grinding the grinding wheel is required to have the reverse form of what is required on the workpiece. The process of grinding then transfers the required form unto the workpiece.

The process of "form grinding" is used in the manufacture of a large variety of accurate and complex shapes in the metal working industry. It is also used to manufacture precision spur and helical gears.

The dressing of the grinding wheel is carried out by means of a rapidly rotating metallic wheel, called a dressing wheel. While the grinding wheel and the dressing wheel are rotated, the dressing wheel is guided through a predetermined path corresponding to the desired form to be imparted to the periphery of the grinding wheel. As the dressing wheel moves through the defined path successively in identical cycles of motion, the grinding wheel is fed into it in equal increments between cycles. Conversely, the dressing wheel may be made to execute subsequent paths with an incremental shift towards the grinding wheel between successive cycles of motion.

There are two distinct problems involved in dressing or profiling a grinding wheel which can be described as the "initial dress problem" and the "redress problem".

INITIAL DRESS PROBLEM

In most instances, grinding wheels are available initially as cylindrical discs. In carrying out the dressing operation, in which the dressing wheel executes the defined path repeatedly in successive cycles and the grinding wheel is gradually and incrementally fed into the path of the dressing wheel, it is obvious that at first only the corners of the grinding wheel will be affected. Gradually as the grinding wheel is fed farther into the path of the dressing wheel, layer upon layer of the grinding wheel will be removed until the entire profile is complete. Although the incremental movement of the grinding wheel is carried out automatically, the instant at which the required form has been achieved on the grinding wheel is a judgment call and requires a skilled operator. If the dressing process is stopped too soon, the form on the grinding wheel will be incomplete or imperfect. If the process is stopped too late, unnecessary loss of grinding wheel material results, with accompanying loss of time.

REDRESS PROBLEM

After the initial dress, the grinding wheel is put into use. As the grinding proceeds the wheel starts to wear. Owing to unevenness in grinding wheel and workpiece characteristics, uneven wear on the grinding wheel is almost always the result. After grinding for a while it therefore becomes necessary to redress the grinding wheel.

The redress of the grinding wheel is carried out similarly to the initial dress. The high spots will be removed first and after several cycles the proper form will be returned to the grinding wheel periphery. However, once again, the instant at which dressing is complete is a judgment call.

PROPOSED SOLUTION

The proposed solution for both of these problems is based on the concept that since the dressing mechanism always executes identical cycles of motion and the wheel is fed into it in equal increments, non-uniform but increasing contact duration will result between the grinding wheel and the dressing wheel. In the initial dress situation, only the corners of the wheel are first in contact. As the grinding wheel is fed into the path of the dressing wheel, more and more contact and consequently an increasing duration of contact is generated. In the redress situation, initially only the high points are in contact until gradually the entire form is in contact. However, in both instances, once the correct profile has been duplicated on the grinding wheel, if dressing is allowed to continue, there is no increase in the duration of contact.

In accordance with the present invention, means are provided for monitoring the duration of contact during each cycle. The difference between the duration of contact in each cycle and the duration of contact in the preceding cycle is determined. When this difference becomes negligible, the dressing operation is complete.

More specifically, the current drawn by the motor used to drive the dressing wheel is monitored with respect to time as a base. When there is no contact between the dressing wheel and the grinding wheel, the current that is required to keep the spindle running is constant (idle current). As the contact time between the dressing wheel and the grinding wheel increases, the torque supplied by the motor to the dressing wheel increases and as a result, the current drawn by the motor increases. This current draw stabilizes only when a full form condition has been reached. A current-time curve for each cycle represents the duration of contact. Integration yields the area under the current-time curve. This may then be compared to the previous cycle and if a significant difference exists, dressing is continued. When the difference becomes negligible, dressing is stopped.

These and other objects of the invention will become more apparent as the following description proceeds, especially when considered with the accompanying drawings.

BRIEF DESCRIPTION OF THE DRAWINGS

FIG. 1 is a fragmentary view illustrating a grinding wheel with its formed periphery in the space between the teeth of a gear.

FIG. 2 is an enlarged fragmentary view of the grinding wheel shown in its relationship to the dressing mechanism and indicating the defined path of the dress wheel in profiling the periphery of the grinding wheel.

FIG. 3 is a diagrammatic view showing the grinding and dressing mechanisms.

FIG. 4 is a fragmentary view of a grinding wheel showing the stages in the removal of layers of grinding wheel material during cycling of the dresser, in an initial dressing operation.

FIG. 5 shows a worn wheel, illustrating also the redressed configuration and the defined path of the dresser wheel. The unevenness of the worn wheel is shown exaggerated for clarity.

DETAILED DESCRIPTION

Figure 6:
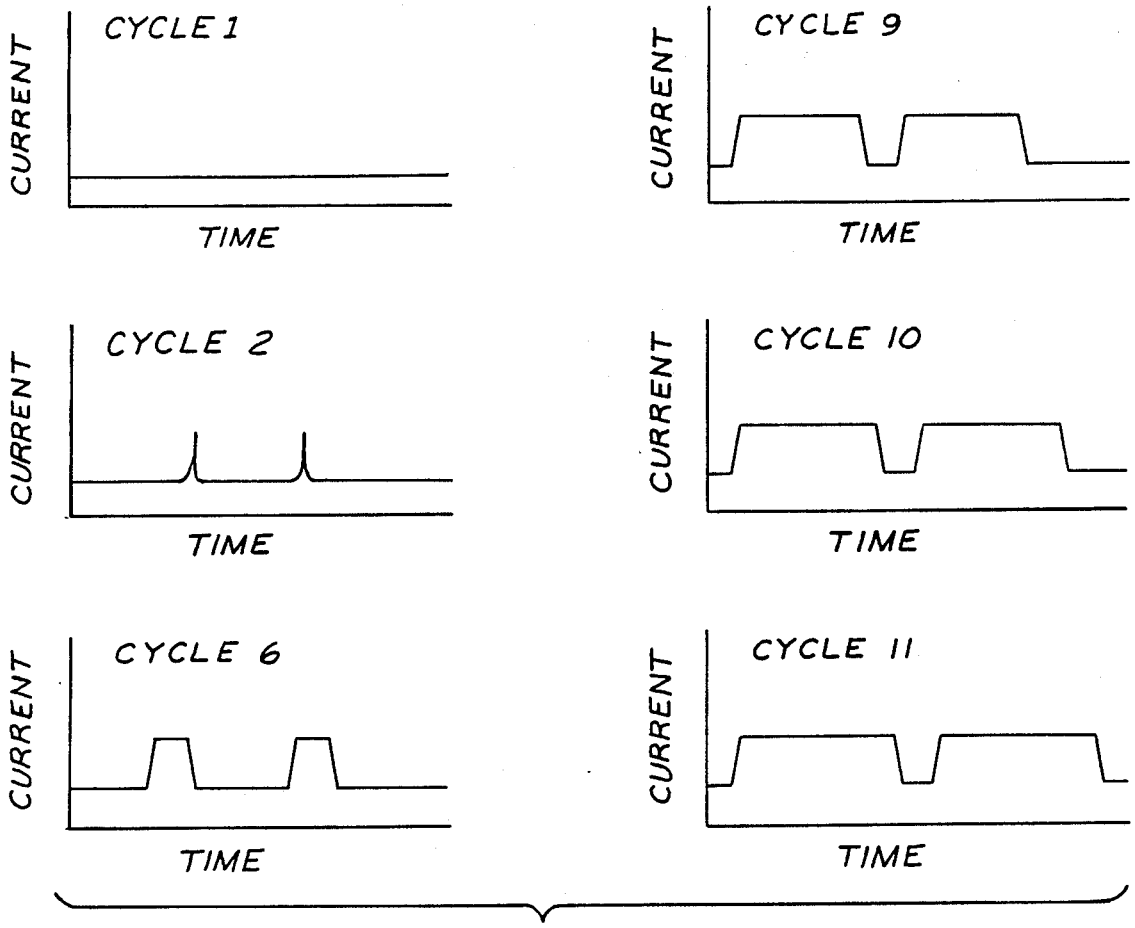
FIG. 6 illustrates the current-time curve in each of a sequence of cycles of the dresser wheel.

Referring now more particularly to the drawings, FIG. 1 shows a circular grinding wheel 10 having a peripheral profile which has the exact reverse form as the space between two adjacent teeth on the workpiece 12, which in this instance is a gear, that has just been ground. In other words, it should be understood that the grinding wheel in FIG. 1 has withdrawn from grinding contact with the gear after completing the grinding process in which two adjacent flanks of the gear teeth and the root have been ground.

The dressing of the grinding wheel, which generally consists of abrasives held in a bond, is generally carried out as shown in FIG. 3. The abrasive wheel is profiled accurately using a rapidly rotating metallic dressing wheel 14 which may have embedded in it particles of diamond or other hard materials such as Cubic Boron Nitride. While the grinding wheel and the dressing wheel are rotating in a specified relationship, the dressing wheel is made to execute motions in the direction of the arrows along a defined path in the VW plane (FIG. 2), to generate the desired form on the grinding wheel. The defined or predetermined path is indicated at 16. This is generally accomplished by having the motor ans spindle carrying the dressing wheel on a mechanism 18 that has two linear axes of motion (V and W directions) under the control of a computer numerical control (CNC) system. As shown in FIG. 3, the dressing wheel spindle 20 is driven by an electric motor 22 carried on a base 24 reciprocable horizontally in ways 26 of the support 28 by means of a motor and ball screw drive 30. The support 28 is movable vertically on ways 32 by means of the motor and ball screw drive 34. The grinding wheel spindle 36 is driven by a motor 40 vertically reciprocable in ways 42 on the column 44 by means of the motor and ball screw drive 46.

The coordinates V and W describing the motion of these two linear axes carried out by the mechanism 18 will already have been generated mathematically since most forms required in metal working can be described mathematically. In gear grinding, the form required on the two flanks of the grinding wheel are generally described by Involutometry and the part of the wheel that grinds the root between the two teeth is generally a simple shape such as a radius, etc. The path 16 typically undertaken by the dressing wheel during the process of dressing the grinding wheel in form gear grinding is shown in FIG. 2. The dressing mechanism causes the dressing wheel to execute the defined path in repeated cycles, and the grinding wheel is fed into the defined path along the Y or vertical axis. Conversely, the dressing mechanism 18 may be made to execute the defined path with incremental upward shifts towards the grinding wheel.

FIG. 4 shows the grinding wheel 10 in its initial cylindrical form and also shows the dressed profile at 50. The area between the corners and the dressed profile is the material that is removed in dressing. When the grinding wheel is gradually and incrementally fed into the path of the dressing wheel, it should be clear that at first only the corners, marked A on FIG. 4, will be removed by the dressing wheel. Gradually, increasing layers of grinding material will be removed in succeeding cycles until the entire dressed profile, indicated at 50, is complete. If the dressing process is stopped too soon, the form on the grinding wheel will have an intermediate shape (marked B in FIG. 4) which would grind an unsatisfactory gear tooth. If the process is stopped too late, the profile C will result, and although it is a correct profile, there has been an unnecessary loss of grinding wheel material and accompanying loss of time.

In the past, the determination of when dressing is complete has required the presence of a skilled human operator who listens for the complete contact between the dressing wheel and the grinding wheel. In the automatic unmanned factories of tomorrow, this will not be acceptable.

In accordance with the present invention, the solution to the problem is based on the concept that since the dressing mechanism always executes identical cycles of motion and the grinding wheel is fed into the path of the dressing wheel in equal increments, non-uniform but increasing contact duration will result between the grinding wheel and the dressing wheel. In the initial dress situation as illustrated in FIG. 4, where only the corners A are first in contact, as the grinding wheel is fed into the path of the dressing wheel there is more and more contact and consequently an increasing duration of contact with each cycle. In redressing as shown in FIG. 5, the situation is virtually the same with the high points of the material 52 to be removed first coming in contact and then gradually increasing contact in subsequent cycles until the entire form is in contact and the redressed profile 50 is achieved.

In both situations, that is initial dress and redress, once the correct profile has been duplicated on the grinding wheel, if grinding is allowed to continue there is no increase in the duration of contact. Identical layers of the wheel will be removed which is both wasteful and unnecessary.

The dressing wheel is mounted on a spindle 20 driven by an electric motor 22. The current drawn by motor 22 is, in accordance with this invention, monitored with respect to time as a base during continuing and repeated cycles. The change in current drawn is illustrated in the sequence of current-time diagrams shown in FIG. 6. When there is no contact (cycle 1), the current is constant and only the current is drawn which is required to keep the spindle running (idle current). As contact occurs between the dressing wheel aand the grinding wheel, the duration of the higher current draw in subsequent cycles increases until it stabilizes at cycles 10 and 11. Full form condition has been then accomplished. A similar characteristic will also be observed in the case of the redress cycle except that initial contacts are somewhat more random.

The basic concept of the optimization technique of this invention is to integrate the current—time curve of the dressing spindle motor 22 during the execution of each complete dressing cycle, as shown in FIG. 6. The integration is done by computer and yields the area under the current—time curve. This is then compared in the computer to the area of the previous cycle and if a difference exists with the value in the present cycle being significantly larger than the value in the next previous cycle, dressing is continued. If the difference is zero or negligible, dressing can stop and the grinding wheel is ready again for service.

Figure 7:
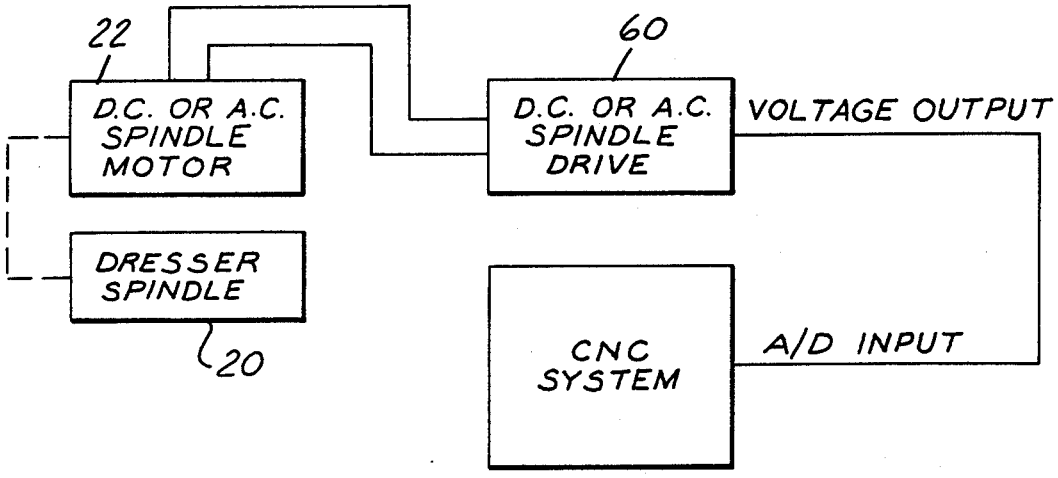
FIG. 7 shows the hardware system.

FIG. 7 shows the essential hardware used in the practice of this invention. The motor 22 for driving the dressing wheel may be either an AC or a DC motor. The power to drive the motor 22 comes from the spindle drive 60 which must of course be compatible with the motor. The spindle drive puts out a voltage which, for monitoring purposes, is proportional to the current being drawn by the motor. This voltage is input to an analog to digital converter 62 which produces a voltage signal proportional to the power (current) required to drive motor 22 and operate dressing wheel 14. The signal produced by the analog to digital converter 62 is transmitted to a comuter integrator 64, which measures and integrates the signal to obtain the area under the current-time curve for one dress cycle, and thus determines the duration of contact for that cycle. The area under the current-time curve for that particular dress cycle is then compared by a comparator 66 with the area under the current-time curve for the previous cycle.

Figure 8:
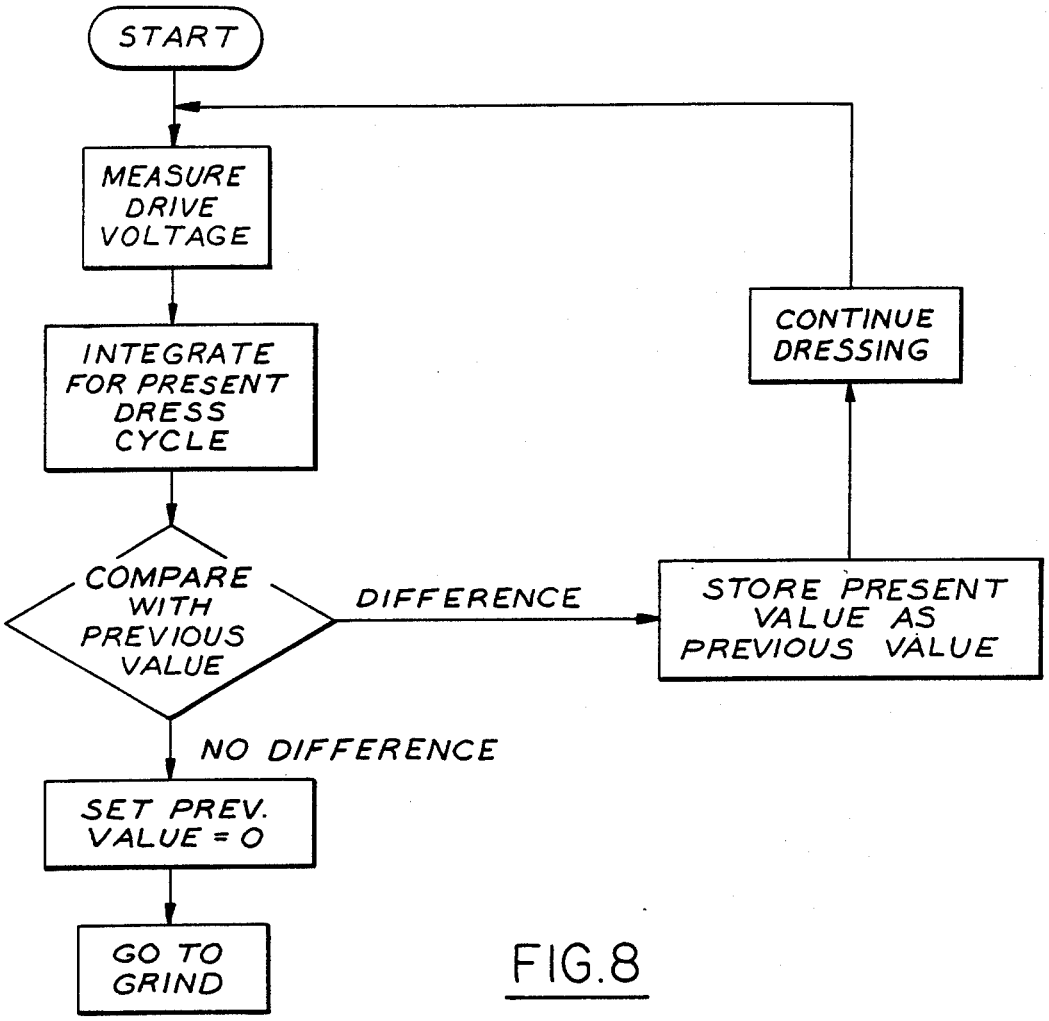
FIG. 8 shows a software flow chart.

The software in the system is shown in FIG. 8. FIG. 8 shows a very high level flow chart. The voltage signal from the analog to digital converter 62 is measured and integrated by computer integrator 64 to obtain the area under the current-time curve for one dress cycle. This is then compared with the previous value, that is, the area under the curve for the previous cycle by comparator 66. If there is a difference, the present value is stored as a previous value in the computer and the dressing cycle is continued with a new present value being obtained. If no difference, or only a negligible difference, is detected, the previous value is set to zero to allow this algorithm to be carried out the next time and the dressing operation is ended.

We claim:

1. Apparatus for dressing a grinding wheel to produce or restore a predetermined profile on the periphery thereof, comprising a dresser, means for relatively guiding said dresser and said wheel along a path corresponding to said predetermined profile successively in identical cycles of motion, means for relatively moving said dresser and grinding wheel transversely of said path in increments between cycles causing said dresser to contact the periphery of said grinding wheel during such movement along said path and the duration of contact to increase with each cycle until said predetermined profile is produced on the periphery of said grinding wheel, and an optimization control system comprising means for determining the duration of contact during each cycle, and means for comparing the duration of contact in successive cycles to ascertain when the difference is minimal and the dressing operation may be discontinued.

2. Apparatus according to claim 1, and further comprising means for automatically discontinuing the dressing operation when said difference is minimal.

3. Apparatus according to claim 1, wherein said determining means supplies contact duration information to a computer which can store said information, and wherein said computer includes said comparing means.

4. Apparatus according to claim 1 further comprising power means for operating said dresser, and wherein said determining means comprises means for producing a signal indicative of contact between said dresser and said wheel as a function of power required to operate said dresser during each cycle, and said comparing means compares the duration of contact in successive cycles by comparing durations of said signals associated with said successive cycles.

5. Apparatus according to claim 4, wherein said power means is electrically operated and the signal produced by said determining means is proportional to current drawn by said power means.

6. Apparatus according to claim 5, wherein said comparing means compares the difference between signals produced by said determining means in successive cycles by integrating the area under a current-time line representative of the current drawn by said power means throughout the duration of each cycle and comparing the same with the area under a current-time line representative of the current drawn by said power means in the preceding cycle.

7. Apparatus according to claim 6, and further comprising means for automatically discontinuing the dressing operation when said difference is minimal.

8. Apparatus according to claim 6, wherein said comparing means supplies contact duration information to a computer which can store said information, and wherein said computer includes said comparing means.

9. An optimization method of dressing a grinding wheel to produce a predetermined profile on the periphery thereof, including the steps of relatively guiding said grinding wheel and a dresser along a path corresponding to said predetermined profile successively in identical cycles of motion, relatively moving said dresser and grinding wheel transversely of said path in increments between cycles causing the dresser to contact the periphery of said grinding wheel during its movement along said path and the duration of contact to increase with each cycle until said predetermined profile is produced on the periphery of said grinding wheel, monitoring the duration of contact during each cycle, comparing the duration of contact in each cycle with the duration of contact in the preceding cycle, continuing such relative movement of said dresser and grinding wheel between cycles until the difference in contact time in a given cycle and the contact time in the preceding cycle is negligible and thereupon discontinuing the dressing operation.

10. An optimization system for controlling a grinding wheel dressing apparatus, said system comprising means for determining the duration of contact between a grinding wheel and a dresser of the apparatus during successive cycles of guided movement between the wheel and the dresser, and means for comparing the duration of contact of successive cycles to ascertain when the difference is minimal to discontinue the dressing operation.

11. A system according to claim 10, wherein said dresser is operated electrically, the duration determining means operates by monitoring the electrical power supplied to operate the dresser, and the comparing means is a computer.

12. A system according to claim 10, and further comprising means for automatically discontinuing the dressing operation when said difference is minimal.

* * * * *

UNITED STATES PATENT AND TRADEMARK OFFICE
CERTIFICATE OF CORRECTION

PATENT NO. : 4,924,842

DATED : May 15, 1990

INVENTOR(S) : Suren B. Rao and Richard W. Swhwartz

It is certified that error appears in the above-identified patent and that said Letters Patent is hereby corrected as shown below:

Figure 7 on sheet 2 of the drawing should appear as per attached sheet.

Signed and Sealed this

Fifth Day of November, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,924,842

DATED : May 15, 1990

INVENTOR(S) : Suren B. Rao and Richard W. Schwartz

It is certified that error appears in the above—identified patent and that said Letters Patent is hereby corrected as shown below:

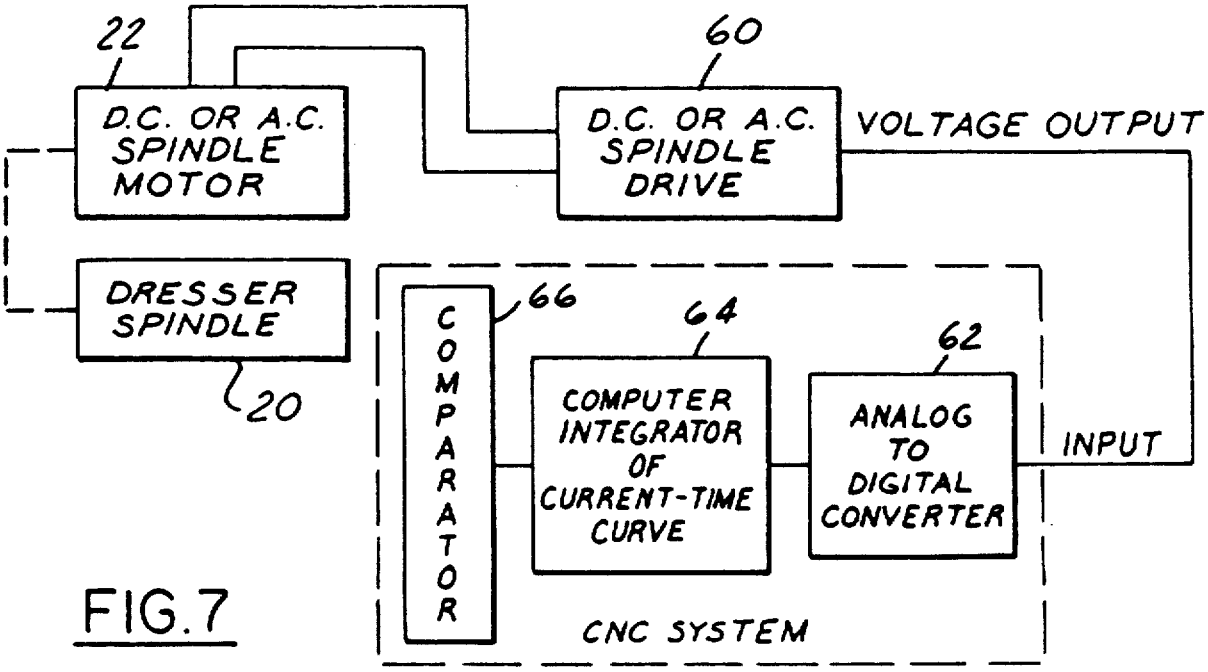

FIG.7